US008490627B2

(12) United States Patent
Levin et al.

(10) Patent No.: US 8,490,627 B2
(45) Date of Patent: Jul. 23, 2013

(54) VAPORIZER WITH FOIL HEAT EXCHANGER

(76) Inventors: Steven Elliot Levin, Ukiah, CA (US); Don Barker Bliss, Ukiah, CA (US)

( * ) Notice: Subject to any disclaimer, the term of this patent is extended or adjusted under 35 U.S.C. 154(b) by 432 days.

(21) Appl. No.: 12/880,865

(22) Filed: Sep. 13, 2010

(65) Prior Publication Data

US 2011/0073121 A1 Mar. 31, 2011

Related U.S. Application Data

(60) Provisional application No. 61/277,822, filed on Sep. 29, 2009.

(51) Int. Cl.
*A24F 1/32* (2006.01)

(52) U.S. Cl.
USPC ..... 131/194; 131/195; 131/196

(58) Field of Classification Search
USPC ..... 131/194, 173, 195, 196, 271
See application file for complete search history.

(56) References Cited

U.S. PATENT DOCUMENTS

| | | | | |
|---|---|---|---|---|
| 4,219,032 | A * | 8/1980 | Tabatznik et al. | 131/329 |
| 5,060,667 | A | 10/1991 | Strubel | |
| 6,089,857 | A | 7/2000 | Matsuura et al. | |
| 7,434,584 | B2 | 10/2008 | Steinberg | |
| 2004/0031495 | A1 * | 2/2004 | Steinberg | 131/194 |
| 2007/0283972 | A1 * | 12/2007 | Monsees et al. | 131/273 |
| 2008/0060663 | A1 * | 3/2008 | Hamade et al. | 131/178 |
| 2009/0293892 | A1 * | 12/2009 | Williams et al. | 131/328 |
| 2010/0101590 | A1 * | 4/2010 | Pflaum | 131/222 |

* cited by examiner

*Primary Examiner* — Richard Crispino
*Assistant Examiner* — Dionne Walls Mayes
(74) *Attorney, Agent, or Firm* — Bay Area Technology Law Group PC

(57) ABSTRACT

This invention vaporizes a botanical substance for inhalation using a combustion generated heat source. A substantially planar non-porous heat exchanger transfers heat to the inhalation air and keeps combustion byproducts separated from the inhalation air. In use, air is drawn past the heat exchanger and then through a reservoir holding the botanical substance, vaporizing any volatiles in the substance. The heat exchanger assembly can be magnetically attached to the pipe assembly.

13 Claims, 7 Drawing Sheets

VAPORIZER WITH FOIL HEAT EXCHANGER

RELATED APPLICATIONS

This application is related to and claims priority horn provisional application Ser. No. 61/277,822 filed on Sep. 29, 2009.

FIELD OF THE PRESENT INVENTION

The present invention generally relates to devices that vaporize volatile components of a botanical substance for human inhalation rather than combusting them. More specifically, the invention is directed to a vaporizer employing a combustion-generated heat source that offers rapid heating and cooling times while maintaining separation between inhalation air and combustion air.

BACKGROUND OF THE INVENTION

Vaporization provides a desirable alternative to combustion for the delivery and consumption of botanical substances. Because vaporization can aerosolize components of botanical substances at a lower temperature than combustion, there is less heat-related degradation of the substances. Furthermore, vaporization avoids the generation of the noxious secondary compounds typically formed by direct combustion, providing obvious health benefits.

As will be appreciated, a vaporizer requires a suitable heat source to generate the necessary heat. For many applications, combustion of a fuel is a practical source of this heat. Combustible fuels allow for easy portability, given their relatively high energy density, and represent a quick and efficient heat source. Other sources of heat, such as electric resistance, require either access to household current or a relatively unwieldy battery to provide the necessary power, and can suffer from slow heating times. Thus, in light of the advantages noted above, a number of attempts have been made to implement vaporizing techniques for the consumption of botanical substances using a combustible fuel source.

For example, U.S. Pat. No. 7,434,584 to Steinberg (2008) describes a vaporizer that uses a butane flame to heat botanicals to a vaporizing temperature. However, the inhalation air and the combustion air are not kept separate, causing the user to be exposed to the combustion byproducts. As such, this device sacrifices one of the significant benefits of employing a vaporizer.

U.S. Pat. No. 5,060,667 to Strubel, on the other hand, is directed to a smoking article that separates the combustion byproducts from the inhalation air. Strubel's design mimics the conventional shape of a cigarette and discloses that the combustion fuel be internal to the device, arranged inside a cylindrical heat exchanger. With no practical means for refueling such a device, it is limited to a single use. Furthermore, the fuel must burn along the axis of the cylindrical device, concentrating the generated heat at different locations during the process. In turn, this creates an uneven temperature profile and offers little control over maintaining the correct vaporization temperature In addition, the Strubel device provides no mechanism for directing inhalation airflow relative to the portion of the fuel actively binning.

Finally, U.S. Pat. No. 6,089,857 to Matsuura is also directed to a flavor generation device that separates the combustion byproducts from the inhalation air. The Matsuura heat exchanger is a plurality of tubes arranged in the combustion area through which the inhalation air is drawn. This arrangement represents a high thermal mass, resulting in a delay in reaching the appropriate vaporizing temperature. This design also causes excessive heating of the device in the regions where the heat exchanger is attached to the device body and is expensive to fabricate.

Accordingly, it would be desirable to provide a vaporizing device for consuming botanical substances that uses the combustion of fuel as a heat source while maintaining separation between the combustion air and the inhalation air. It would also be desirable to provide a device that quickly and efficiently exchanges the combustion heat to the botanical substance while ensuring that the flow of inhalation air is directed past the hottest portion of the exchanger. Further, it would be desirable to provide a device that is readily and easily reusable. This invention satisfies these and other needs.

SUMMARY OF THE INVENTION

In accordance with the above objects and those that will be mentioned and will become apparent below, this disclosure is directed to a device for vaporizing volatiles of a botanical substance, comprising a pipe assembly having an inhalation air pathway and a reservoir positioned in the inhalation air pathway that is configured to receive the botanical substance to be vaporized, and a heat exchanger assembly operatively coupled to the pipe assembly in communication with the inhalation air pathway, wherein the heat exchanger assembly has a substantially planar, non-porous heat exchanger member having a first face and an opposing second face in which the first face is configured to be exposed to a combustion source and the second face is exposed to the inhalation air pathway. Preferably, the heat exchanger member is made of metal foil, such as nickel metal. Also preferably, the heat exchanger member has a thickness in the range of approximately 0.01 to 0.25 mm.

In a further aspect of the disclosure, the heat exchanger assembly further comprises a substantially planar air guide spaced apart from the second face of the heat exchanger member so as to define at least one inlet pathway and at least one outlet pathway in communication with the inhalation air pathway of the pipe assembly. Preferably, the inlet pathway comprises a plurality of openings spaced adjacent the air guide's periphery and the outlet pathway comprises a plurality of openings adjacent the air guide's center. In the noted embodiment, the heat exchanger assembly preferably has first and second opposing sides and the first face of the heat exchanger member is positioned on the first side of the heat exchanger assembly and the inlet pathway openings communicate with openings on the second side of the heat exchanger assembly. Also preferably, the assembly includes a frame to which the heat exchanger member and the air guide are attached so that inhalation air is channeled from a location removed from the heat exchanger member. More preferably, a plurality of axial holes in the frame are in communication with the inlet of the air guide and extend to the bottom surface of the frame.

In another aspect, the heat exchanger member preferably has a concave depression on the first face configured to deflect heat from the combustion source away from the member periphery and heat exchanger frame. Also preferably, the heat exchanger member has a plurality of radial ridges which stiffen the heat exchanger member to minimize expansion and flex when heated and stabilize the distance of the heat exchanger member to the air guide.

One embodiment of the disclosure is directed a removable attachment means between the heat exchanger assembly and the pipe assembly. Prefer ably, the removable attachment means is magnetic.

In yet another aspect, the pipe assembly further comprises a reservoir assembly that has a plurality of chambers, each of which is configured to receive the botanical substance and can be positioned independently in the inhalation air pathway.

The disclosure is also directed to a method for vaporizing volatiles from a botanical substance comprising the steps of providing a device with a pipe assembly having an inhalation air pathway and a reservoir positioned in the inhalation air pathway that is configured to receive the botanical substance to be vaporized, and a heat exchanger assembly operatively coupled to the pipe assembly in communication with the inhalation air pathway, wherein the heat exchanger assembly has a substantially planar, non-porous heat exchanger member having a first face and an opposing second face in which the first face is configured to be exposed to a combustion source and the second ace is exposed to the inhalation air pathway, applying heat from the combustion source adjacent the first face of the heat exchanger member, and drawing air through the inhalation air pathway so that air is heated as it passes the second face of the heat exchanger member and then subsequently drawn through the botanical substance in the reservoir at a temperature sufficient to vaporize the volatiles of the botanical substance.

BRIEF DESCRIPTION OF THE DRAWINGS

Further features and advantages will become apparent from the following and more particular description of the preferred embodiments of the invention, as illustrated in the accompanying drawing, and in which like referenced characters generally refer to the same parts or elements throughout the views, and in which.

DETAILED DESCRIPTION OF THE INVENTION

This disclosure is directed to the vaporization of a botanical substance for inhalation using a combustion generated heat source. A substantially planar non-porous heat exchanger transfers heat to the inhalation air and keeps combustion byproducts separated from the inhalation air. In use, air is drawn past the heat exchanger and then through a reservoir holding the botanical substance, vaporizing any volatiles in the substance. The heat exchanger assembly can be magnetically attached to the pipe assembly.

At the outset, it is to be understood that this disclosure is not limited to particularly exemplified materials, methods or structures as such may, of course, vary. Thus, although a number of materials and methods similar or equivalent to those described herein can be used in the practice of embodiments of this disclosure, the preferred materials and methods are described herein.

It is also to be understood that the terminology used herein is for the purpose of describing particular embodiments of this disclosure only and is not intended to be limiting.

Unless defined otherwise, all technical and scientific terms used herein have the same meaning as commonly understood by one having ordinary skill in the art to which the disclosure pertains.

Further, all publications, patents and patent applications cited herein, whether supra or infra, are hereby incorporated by reference in their entirety.

Finally, as used in this specification and the appended claims, the singular forms “a, “an” and “the” include plural referents unless the content clearly dictates otherwise.

Figure 1:
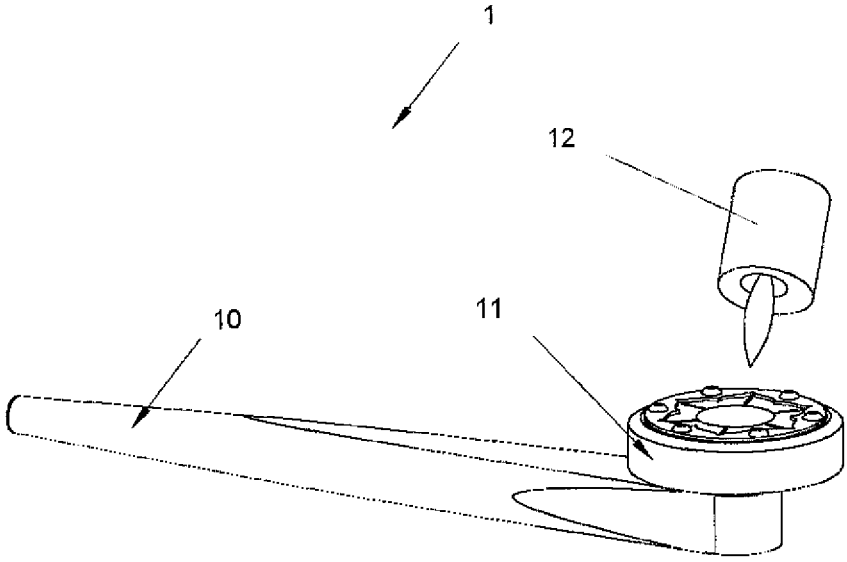
FIG. 1 is an elevational view of an embodiment of the invention showing application of heat from a combustion source to vaporize the botanical substance.

Turning now to FIG. 1, a vaporizer device 1 according to the invention is shown having a pipe assembly 10 and a heat exchanger assembly 11, which is preferably removably attached to the pipe. A suitable combustion source 12 is applied to the heat exchanger assembly, for example, a conventional butane-fueled torch style cigar lighter.

Figure 2:
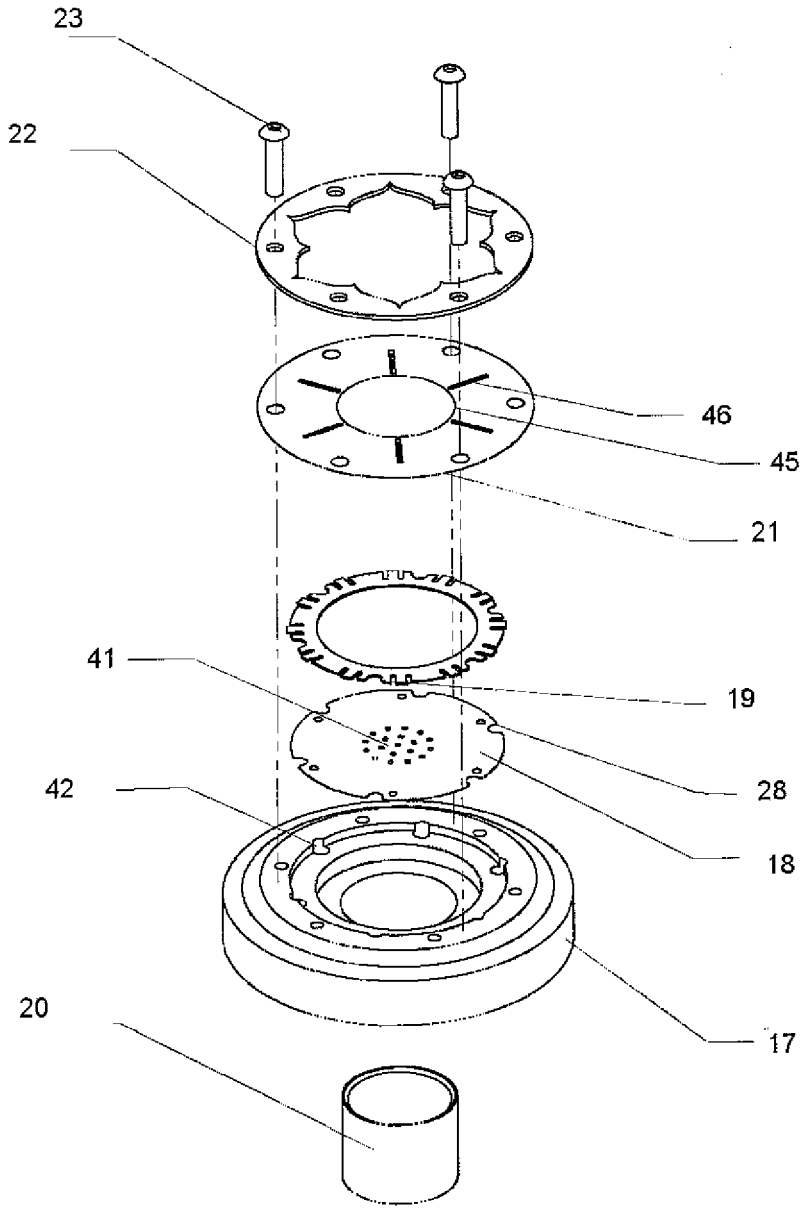
FIG. 2 is an exploded view of overview of the heat exchanger assembly of an embodiment of the invention.

FIG. 2 is a detail of heat exchanger assembly 11, shown in exploded view. Generally, the heat exchanger assembly 11 includes heat exchanger frame 17, air guide 18, inner clamp ring 19, sleeve 20, heat exchanger disk 21, outer clamp ring 22 and cap screws 23. As shown, heat exchanger frame 17 is preferably a wood cylinder with two concentric stepped cutouts on the top surface and a through hole in its center. There are also several axial through holes 42 located at the exterior edge of the uppermost stepped cutout. A second stepped cutout is located below the first stepped cutout. Air guide 18 rests in the uppermost stepped cutout of heat exchanger frame 17. As such, air guide 18 is a substantially planar member. In the embodiment shown, air guide 18 is a circular disk having a diameter allowing it to be received by the uppermost cutout, however other shapes and configurations can be employed as desired, such as oval, square or rectangular. Preferably, air guide 18 is formed from a suitable material, such as a stainless steel foil.

Air guide 18 has a plurality of openings in the form of notches 28 cut into its periphery as well as a plurality of openings 41 in the form of holes positioned adjacent its center. Inner clamp ring 19 is also formed from a suitable material, such as stainless steel, and has corresponding notches and mounting fingers located around the periphery configured to coordinate with air guide 18 to orient the notches. Notches 28 are aligned with through holes 42. Sleeve 20 is a hollow cylinder of the same outer diameter as the through hole of the heat exchanger flame 17. The heat exchanger member 21 is made of a suitable thin metal, such as nickel foil, and is of a diameter intermediate to the outer diameter and the topmost cutout of heat exchanger flame 17. Prefer ably, heat exchanger member 21 has a thickness in the range of approximately 0.01 to 0.25 mm. Heat exchanger member 21 can also be coated with a noble metal if desired, to minimize oxidation. Preferably, the member has a concave shape 45 at its center which acts to deflect heat from combustion source 12 away from the periphery of heat exchanger member 21 and frame 17. Also preferably, heat exchanger member 21 has approximately linear indentations in the form of ridges 46 that are radially spaced around the concave shape 45 to stiffen the member, minimizing expansion and flex when heated and stabilizing the distance between heat exchanger member 21 and air guide 18. Alternatively, other functional or ornate configurations can be substituted.

Heat exchanger member 21 is spaced apart from air guide 18 by inner clamp ring 19. As noted above, the shape of heat exchanger member 21 is not required to be circular, and other shapes and configurations can be employed as desired, such as oval, square or rectangular.

Outer clamp ring 22 is a ring of the same outer diameter as heat exchanger member 21, and is preferably formed from stainless steel also. Cap screws 23, of which three are shown for clarity, penetrate outer clamp ring 22 and heat exchanger member 21 to secure the components to frame 17. Preferably, the uppermost stepped cutout of flame 17 is sized so that air guide 18 is firmly held in place by the pressure exerted by the flexing of the fingers of inner clamp ring 19, which has an outer diameter which is slightly oversized compared to the uppermost stepped cutout of frame 17. Also preferably, the distance from the bottom of the concave shape of the heat exchanger disk 21 to the top of the air guide 18 is in the range of approximately 0.005" and 0.050" (0.127 to 1.27 mm).

Figure 3:
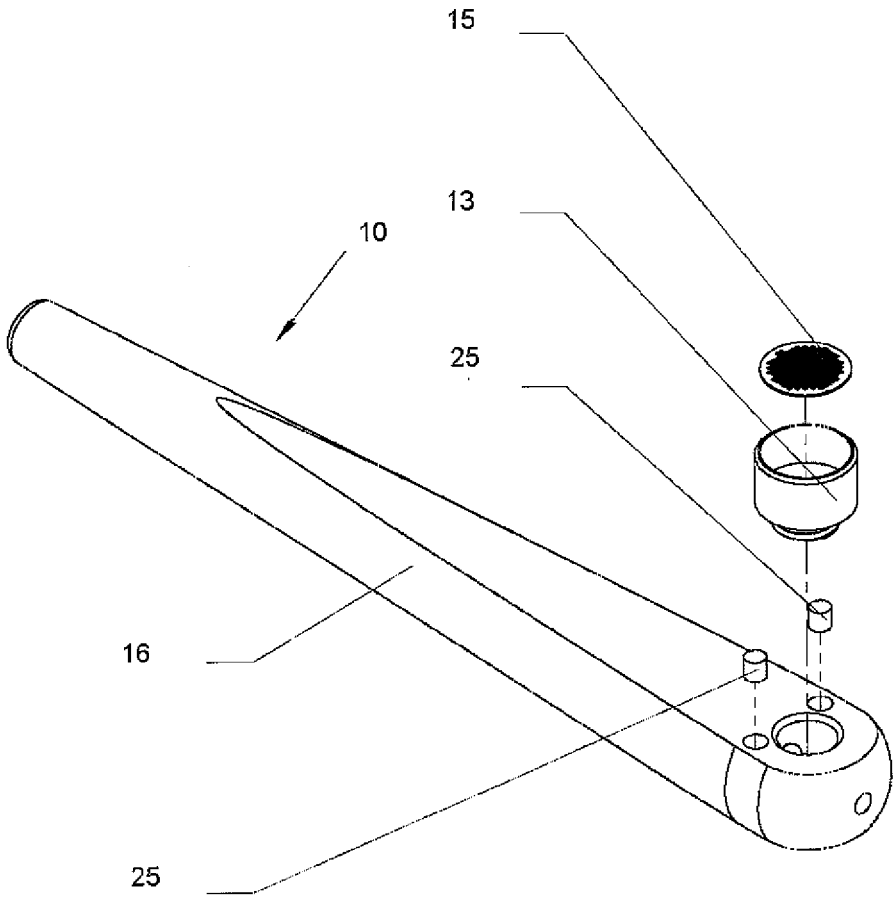
FIG. 3 is an exploded view of overview of the pipe assembly of an embodiment of the invention.

FIG. 3 shows an exploded view of the pipe subassembly 10, generally including stem 16, reservoir (or bowl) 13, screen 15 and magnets 29. Stem 16 can be made of a suitable material such as aluminum and preferably has a vertical threaded hole that is joined to a horizontal through hole. Reservoir 13 is a stepped or tapered cylinder, preferably made of stainless steel, having an outer diameter configured to fit closely within the interior diameter of the sleeve 20. Also preferably, reservoir 18 threads into stem 16 to provide a removable attachment. When attached a bore through stem 16 communicates with the interior of reservoir 13. Screen 15 may be made of stainless steel wire and rest within reservoir 13. Magnets 25 are secured to stem 16 and located to provide a removable attachment to heat exchanger assembly 11 via attraction to sleeve 20. By providing a removable attachment means, rapid and easy access to reservoir 13 is provided.

Figure 4:
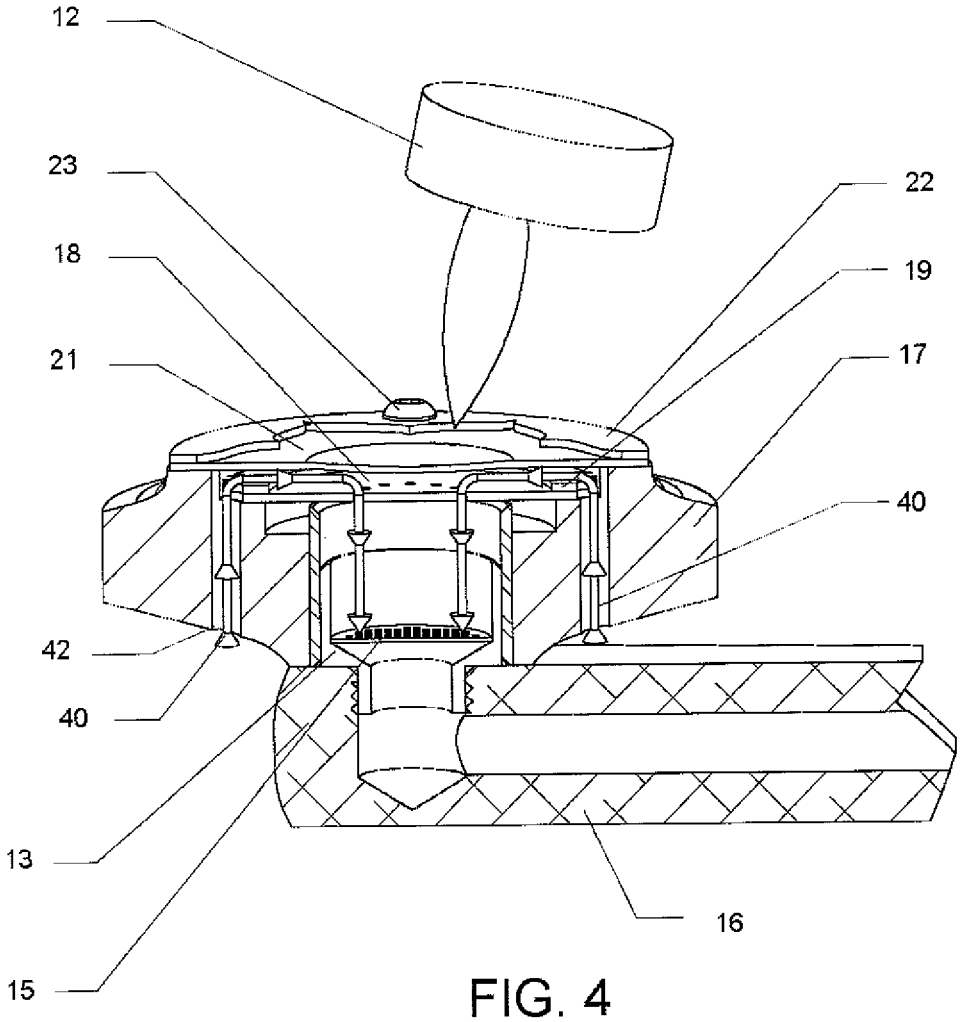
FIG. 4 is a cross-sectional view of an embodiment of the invention.

Operation of the vaporizer 1 is schematically depicted in the cutaway view of FIG. 4. The botanical substance is positioned within reservoir 13, which is connected by screw threads to stem 16. Heat exchanger assembly 11 is magnetically secured to pipe assembly 10 as described above. Air inhalation pathway 40 allows outside air to be drawn through passageways formed by through holes 42 in frame 17. Pathway 40 continues through the space formed between the opposing surfaces of air guide 18 and heat exchanger member 21, with notches 28 providing the inlet and openings 41 (numbering omitted in FIG. 4 for clarity) providing the outlet. Inhalation air then follows pathway 40 through the botanical substance held in reservoir 13 and finally through the bore of stem 16

Heat is applied to the concave area of heat exchanger member 21, so that air drawn along pathway 40 is rapidly warmed to a suitable vaporization temperature in the space between heat exchanger member 21 and air guide 18. The heated air then flows through the openings 41 at the center of the air guide 18 into and around the botanicals that are in reservoir 13, vaporizing volatiles in the botanicals. At this point the inhalation air becomes vapor, holding the volatiles in suspension in the inhalation air. The vapor then flows through screen 15 and into the stem 16. Preferably, the hole patterns of openings 41 in air guide 18 act to equalize the vaporization across the bowl from edge to edge by distributing the flow of inhalation air and vapor within the cross-section of the reservoir 13 interior.

As will be appreciated, the user can control the vaporization temperature by varying the distance of the combustion source 12 from the heat exchanger member 21 and by varying the speed of the inhalation air that is drawn along pathway 40. Specifically, the air becomes hotter both when the air is drawn through the invention at a slower speed and when the combustion source 12 is closer to the heat exchanger member 21.

The design of heat exchanger 21 and inhalation air pathway 40 provide a number of advantages. For example, the flow pattern of inhalation air moving radially from the outer periphery to the center of heat exchanger member 21 and the intended combustion source target cooperate to keep the outer edge and attachment points of heat exchange member 21 relatively cool. Further, the substantially planar configuration and thinness of heat exchanger member 21 decreases the resistance to heat flow between the heated and non-heated faces due to the short distance. Also, the use of a thin foil minimizes the heat flow from the center of heat exchange member 21 to its edge due to the small cross section of the foil transmitting the heat in relation to the relatively large heat dissipating area of the surface from the center to the outer edge. The thin foil also represents a relatively small thermal mass, allowing heat exchange member 21 to heat rapidly at the beginning of use and cool rapidly following use.

The embodiments noted above are directed to the use of a combustion driven heat source. However, one of skill in the art will recognize that other heat sources could also be used. For example, a directed stream of hot air from an electrical "heat gun" could be used to heat the heat exchanger surface. A radiant source of heat focused on the heat exchanger surface could also be used as a heat source, such as electrical radiant heaters and gas fueled radiant heaters.

Figure 5:
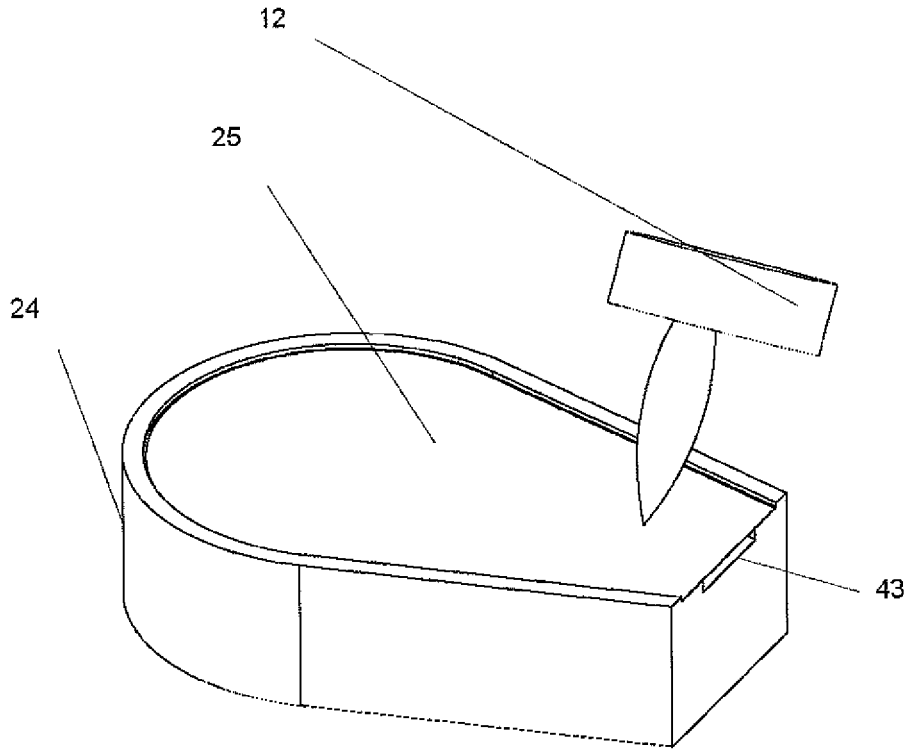
FIG. 5 is an elevational view of an alternate embodiment of the invention.

In another embodiment of the invention is shown in FIG. 5, featuring an air guide with a transverse air flow as opposed to a radial air flow. Specifically, combustion source 12 is used to apply heat to an outer surface of heat exchanger member 25. Inhalation air is drawn through inlet 43, underneath heat exchanger member 25, through a supply of botanical substance and then out opening 24

Figure 6:
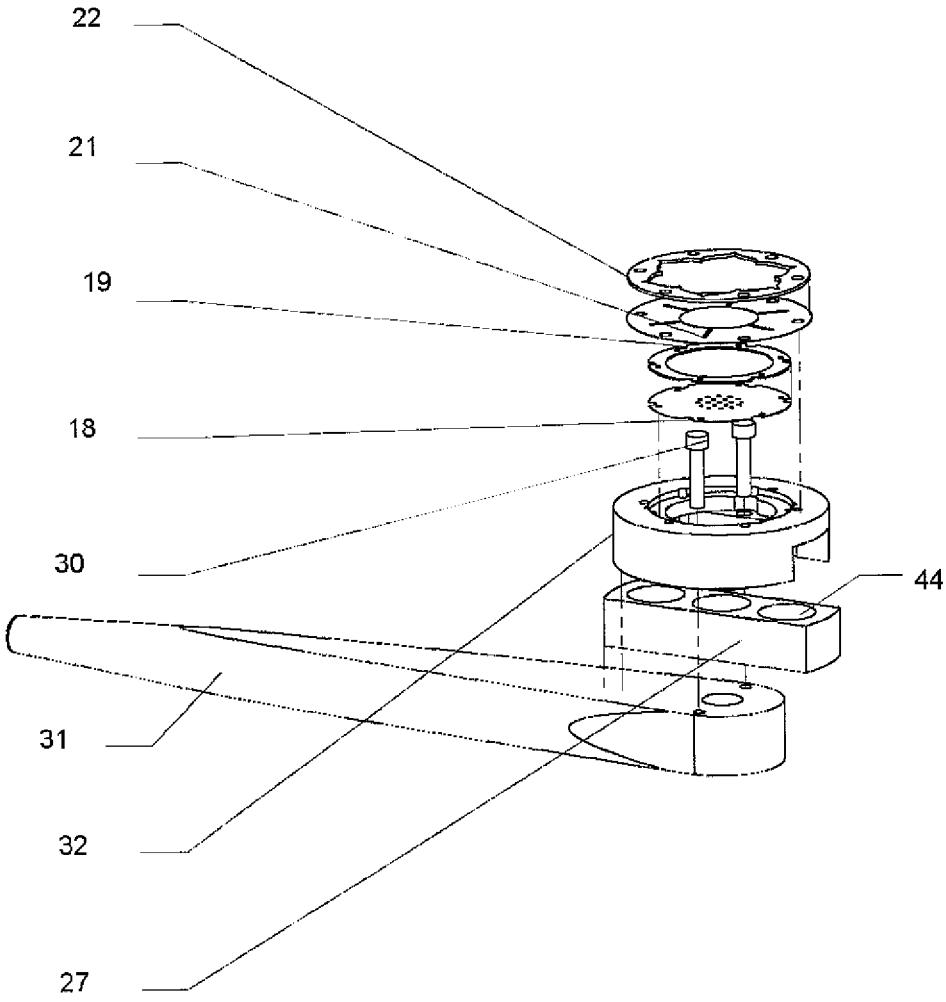
FIG. 6 is an exploded view of another alternate embodiment of the invention, showing a reservoir assembly with a plurality of chambers.
Figure 7:
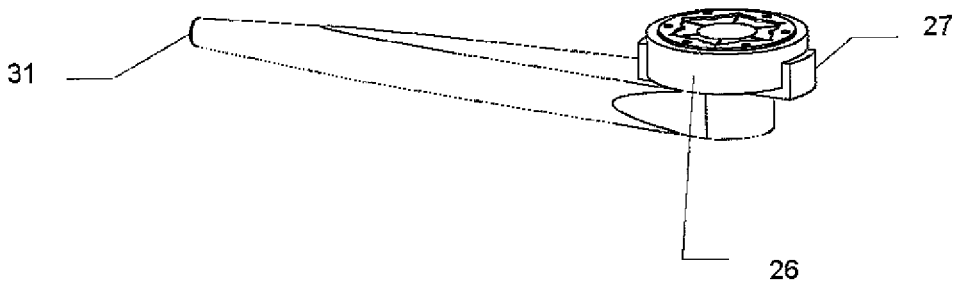
FIGS. 7 and 8 are perspective views of the embodiment shown in FIG. 6.
Figure 8:
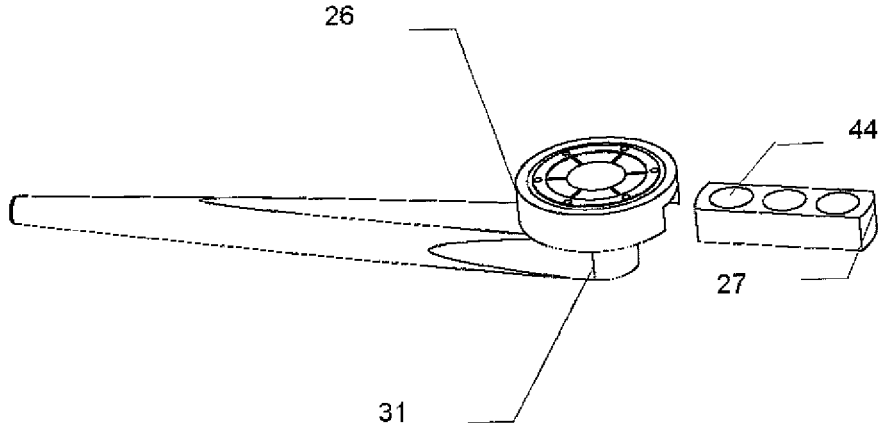

Yet another embodiment of the invention is depicted in FIGS. 6-8. The fundamental features of the vaporizer are equivalent, except that stem 31 of the pipe assembly features a reservoir assembly 27 having a plurality of chambers 44. Heat exchanger assembly 26 includes heat exchanger frame 32 is secured to stem 31 by screws 30, allowing reservoir assembly 27 to slide transversely, bringing each chamber 44 independently into the inhalation air pathway. As shown in FIG. 7, reservoir assembly 27 is positioned to place center chamber 44 into the inhalation air pathway. Similarly, FIG. 8 shows reservoir assembly 27 removed from heat exchanger assembly 26 for cleaning or loading of the botanical substance.

Described herein are presently preferred embodiments, however, one skilled in the art that pertains to the present invention will understand that the principles of this disclosure can be extended easily with appropriate modifications to other applications. For example, inhalation air may be pushed through a vaporizer of the invention by a person or fan or compressor instead of being drawn in by a person. The vapor produced may then be stored in a container such as a flexible bag for later use. Alternatively, the vapor produced could be distributed over a wide area instead of to an individual.

What is claimed is:

1. A device for vaporizing volatiles of a botanical substance, comprising:

a) a pipe assembly having an inhalation air pathway and a reservoir positioned in the inhalation air pathway that is configured to receive the botanical substance to be vaporized;

b) a heat exchanger assembly operatively coupled to the pipe assembly in communication with the inhalation air pathway, wherein the heat exchanger assembly has a substantially planar, non-porous heat exchanger member having a first face and an opposing second face in which the first face is configured to be exposed to a combustion source and combustion byproducts and the second face is exposed to the inhalation air pathway and wherein the non-porous heat exchanger member maintains separation of the inhalation air pathway from the combustion byproducts; and c) a substantially planar air guide spaced apart from the second face of the heat exchanger member so as to define at least one inlet pathway and at least one outlet pathway in communication with the inhalation air pathway of the pipe assembly.

2. The device of claim 1, wherein the heat exchanger member is made of metal foil.

3. The device of claim 2, wherein the heat exchanger member is made of nickel foil.

4. The device of claim 2, wherein the heat exchanger member has a thickness in the range of approximately 0.01 to 0.25 mm.

5. The device of claim 1, wherein the inlet pathway comprises a plurality of openings spaced adjacent the air guide's periphery and wherein the outlet pathway comprises a plurality of openings adjacent the air guide's center.

6. The device of claim 5, wherein the heat exchanger assembly has first and second opposing sides and the first face of the heat exchanger member is positioned on the first side of the heat exchanger assembly and the inlet pathway openings communicate with openings on the second side of the heat exchanger assembly.

7. The device of claim 5, wherein the heat exchanger member has a concave depression on the first face configured to deflect heat from the combustion source positioned opposing the outlet openings of the air guide away from a periphery of the heat exchanger member.

8. The device of claim 1, wherein the heat exchanger member has a concave depression on the first face.

9. The device of claim 1, wherein the heat exchanger member has a plurality of ridges.

10. The device of claim 1, further comprising a removable attachment means between the heat exchanger assembly and the pipe assembly.

11. The device of claim 10, wherein the removable attachment means is magnetic.

12. The device of claim 1, wherein the heat exchanger assembly comprises a frame to which the heat exchanger member and the air guide are attached so that inhalation air is channeled from a location removed from the heat exchanger member.

13. The device of claim 12, wherein the frame comprises a bottom surface and a plurality of axial holes, wherein the axial holes are in communication with the inlet of the air guide and extend to the bottom surface of the frame.

* * * * *